US005871059A

United States Patent [19]

Shibata et al.

[11] Patent Number: 5,871,059

[45] Date of Patent: Feb. 16, 1999

[54] MECHANISM FOR PREVENTING IDLING STRIKES IN POWER-DRIVEN STRIKING TOOLS

[75] Inventors: Mitsuyoshi Shibata; Masaki Sakuraghi; Yoshihiro Kasuya, all of Anjo, Japan

[73] Assignee: Makita Corporation, Aichi, Japan

[21] Appl. No.: 607,936

[22] Filed: Feb. 28, 1996

[30] Foreign Application Priority Data

Feb. 28, 1995 [JP] Japan ..... 7-040832

[51] Int. Cl.[6] ..... B25D 9/04

[52] U.S. Cl. ..... 173/211; 173/133

[58] Field of Search ..... 173/211, 210, 173/204, 121, 128, 133; 279/19–19.7

[56] References Cited

U.S. PATENT DOCUMENTS

| | | | |
|---|---|---|---|
| 1,825,632 | 9/1931 | Korvin-Kroukovsky et al. | 173/18 |
| 2,372,029 | 3/1945 | Stair | 173/31 |
| 2,457,969 | 1/1949 | Anderson | 173/107 |
| 2,767,988 | 10/1956 | Dietrich et al. | 279/19.5 |
| 2,899,934 | 8/1959 | Salengro | 173/18 |
| 3,022,838 | 2/1962 | Mitchell | 173/120 |
| 3,241,622 | 3/1966 | Ottoson et al. | 173/18 |
| 3,266,581 | 8/1966 | Cooley et al. | 173/162.1 |
| 3,451,492 | 6/1969 | Ekstrom et al. | 173/211 |
| 3,847,229 | 11/1974 | Wanner et al. | 173/48 |
| 3,850,255 | 11/1974 | Koehler | 173/210 |
| 3,866,692 | 2/1975 | Stelljes | 173/48 |
| 3,926,266 | 12/1975 | Dorgnon | 173/110 |
| 3,998,278 | 12/1976 | Stiltz et al. | 173/13 |
| 4,123,074 | 10/1978 | Wanner | 279/19.5 |
| 4,131,165 | 12/1978 | Wanner et al. | 173/211 |
| 4,290,492 | 9/1981 | Sides et al. | 173/118 |
| 4,442,906 | 4/1984 | Simpson | 173/48 |
| 4,476,941 | 10/1984 | Buck et al. | 173/133 |
| 4,585,077 | 4/1986 | Bergler | 279/19 |
| 4,602,689 | 7/1986 | Wanner | 173/127 |
| 4,624,325 | 11/1986 | Steiner | 173/139 |
| 4,750,567 | 6/1988 | Grossmann et al. | 173/13 |
| 5,050,687 | 9/1991 | Prokhorov | 173/133 |
| 5,111,890 | 5/1992 | Ranger et al. | 173/104 |
| 5,522,606 | 6/1996 | Pressley e al. | 279/91 |
| 5,573,073 | 11/1996 | Schofield et al. | 173/17 |
| 5,603,516 | 2/1997 | Neumaier | 279/19.5 |
| 5,775,441 | 7/1998 | Sakuragi et al. | 173/200 |

FOREIGN PATENT DOCUMENTS

| | | |
|---|---|---|
| 0 218 547 | 6/1990 | European Pat. Off. . |
| 0218547 | 6/1990 | European Pat. Off. . |
| 3531641 | 3/1987 | Germany . |
| 1-240278 | 9/1989 | Japan . |
| 2 147 240 | 5/1995 | United Kingdom . |

*Primary Examiner*—Michael J. Carone
*Assistant Examiner*—Darren Ark
*Attorney, Agent, or Firm*—Lahive & Cockfield, LLP

[57] ABSTRACT

The present invention realizes effective recoil reduction and idling strike prevention with a minimum constitution. In a tool holder (6), a thermal-resistant O-ring (22) is arranged between two steel washers (21,23) near the joint to the barrel (5). The O-ring (22) has a cross-sectional diameter of approximately 7 mm. The inner diameter of the O-ring (22) is made slightly greater than the diameter of a cylindrical portion (19*b*) formed at the rear of an intermediate element (19) and slightly smaller than the diameter of a flange (19*a*) formed at the rear of the cylindrical portion (19*b*). Likewise, the inner diameter is made slightly greater than the diameter of a recess (18*b*) of a striking member (18) formed in front thereof and slightly smaller than the diameter of a flange (18*a*) formed in front of the recess (18*b*). The cylindrical portion (19*b*) of the intermediate element (19) is extended backward for such a distance that, when the cylindrical portion (19*b*) is fitted in the O-ring (22), the flange (19*a*) is positioned behind, and out of contact with, the O-ring (22).

8 Claims, 3 Drawing Sheets

MECHANISM FOR PREVENTING IDLING STRIKES IN POWER-DRIVEN STRIKING TOOLS

BACKGROUND OF THE INVENTION

1. Field of the Invention

The present invention relates to a power-driven striking tool, such as a power-driven hammer or a power-driven hammer drill. More specifically, the invention pertains to a power-driven striking tool with a striking member, which connects with a piston reciprocating in a housing and strikes a bit attached to an end of the housing directly or indirectly via an intermediate element interposed between the striking member and the bit.

2. Description of the Related Art

Power-driven striking tools may be provided with a mechanism for preventing idling strikes as disclosed in JAPANESE PATENT LAYING-OPEN GAZETTE No. 1-240278. According to this mechanism, while the tool is operated idly, with the bit not in contact with the ground or some other work surface, the striking member is gripped by a gripping member when thrust in the forward position, so that the striking member is no longer interlocked with the piston. A cushioning material provided in front of the intermediate element cushions the impact of the intermediate element thrust forward by the first idling strike and prevents the intermediate element from recoiling and dislodging the striking member from the gripping member. Furthermore the mechanism has another cushioning material provided behind the intermediate element for reducing the recoil of the bit transmitted to the main body of the tool in normal operation.

In the prior art described above, the functions of gripping the striking member for preventing idling strikes, braking the thrusting intermediate element, and reducing the recoil of the bit in normal operation are performed in different locations, such as between the striking member and the intermediate element and in front of the intermediate element. Consequently, a number of additional parts are required for these functions, resulting in a more complex structure and increased manufacturing process and cost. The same is true of the type of tools without an intermediate element; such a tool also requires a gripping member for gripping the striking members as well as a separate cushioning material for preventing recoil of the bit.

SUMMARY OF THE INVENTION

The object of the present invention is thus to provide a simply structured mechanism that is capable or preventing idling strikes in a striking tool and reducing the recoil of the bit and other impacts.

In order to realize the above and the other objects, the present invention is directed to a mechanism whose structure for use in the type of tools having an intermediate element between the striking member and the bit is characterized by an elastic member provided between the intermediate element and the striking member, and a damper provided on the intermediate element. The elastic member, capable of holding and releasing the intermediate element and the striking member, holds the intermediate element in normal operation. The damper, while out of contact with the elastic member and positioned on the same side of the elastic member as the striking member comes into contact with the elastic member to decrease the momentum of the intermediate element in idle operation.

On the other hand, the structure of the mechanism for use in the type of tool having no intermediate element is characterized by an elastic member provided between the bit and the striking member and a damper provided on the bit. The elastic member, capable of holding and releasing the rear end of the bit and the striking member, holds the bit in normal operation. The damper, while out of contact with the elastic member and positioned on the same side of the elastic member as the striking member comes into contact with the elastic member to decrease the momentum of the bit in idle operation.

In the above conventional structures, the elastic member may be an O-ring. Meanwhile, the damper may be a flange formed on a cylindrical portion of the intermediate element or the bit, around which the O-ring may be positioned, in such a manner that the outer diameter of the flange is larger than the inner diameter of the O-ring.

In the type including an intermediate element, the intermediate element is held in and supported by the elastic member in normal operation. Therefore, the recoil of the bit subjected to strikes are cushioned and absorbed by the elastic member when it is transmitted to the intermediate element, thereby lessening the vibration and impact transmitted to the main body of the tool.

In idle operation, the striking member strikes and dislodges the intermediate element from the elastic member. At the same time, the striking member fits into the elastic member in place of the intermediate element so as to disconnect the interlock between the piston and the striking member. Meanwhile, as the intermediate element is dislodged from the elastic member, the damper comes into contact with the elastic member following the collision with the striking member, with the result that the intermediate element is braked. This decreases the recoil of the intermediate element and prevents it from bumping the striking member out of the elastic member.

Likewise in the type of tool in which the striking member directly strikes the bit, the bit is held in and supported by the elastic member in normal operation. Therefore, the recoil of the bit subjected to strikes are cushioned and absorbed by the elastic member when it is transmitted to the intermediate element, thereby lessening the vibration and impact transmitted to the main body of the tool.

In idle operation, the striking member is thrust and fitted into the elastic member, so that the interlock between the piston and the striking member is disconnected. Meanwhile, the damper of the thrusting bit comes into contact with the elastic member following the collision with the striking member, thereby braking the bit. This decreases the recoil of the bit and prevents it from bumping the striking member out of the elastic member.

If an O-ring is used as the elastic member and the damper of the intermediate element or the bit is formed of a cylindrical member and a flange as described above, the O-ring is brought into contact with, and detached from, the intermediate element or the bit around its entire outer periphery. As a result, the recoil reduction in normal operation and the braking effect in idle operation will be particularly enhanced.

According to the present invention, in both types of striking tools with and without an intermediate element, a single elastic member provided in one location reduces the recoil of the bit in normal operation, catches the striking member and brakes the intermediate element or the bit in idle operation. This minimal configuration provides effective and efficient braking and idling strike prevention, thus resulting in reduced manufacturing cost and process.

If an O-ring is used as the elastic member and the damper provided on the intermediate element or the bit is composed of a cylindrical portion and a flange as described above, the O-ring comes into contact with the entire periphery of the flange of the intermediate element or the bit by engaging with and releasing the flange formed thereon, resulting in excellent cushioning and braking in idle operation.

These and other objects, features, aspects, and advantages of the present invention will become more apparent from the following detailed description of the preferred embodiments with the accompanying drawings.

DESCRIPTION OF THE PREFERRED EMBODIMENT

Preferred embodiments of the present inventions will now be explained with reference to the attached drawings.

Embodiment 1

Figure 1:
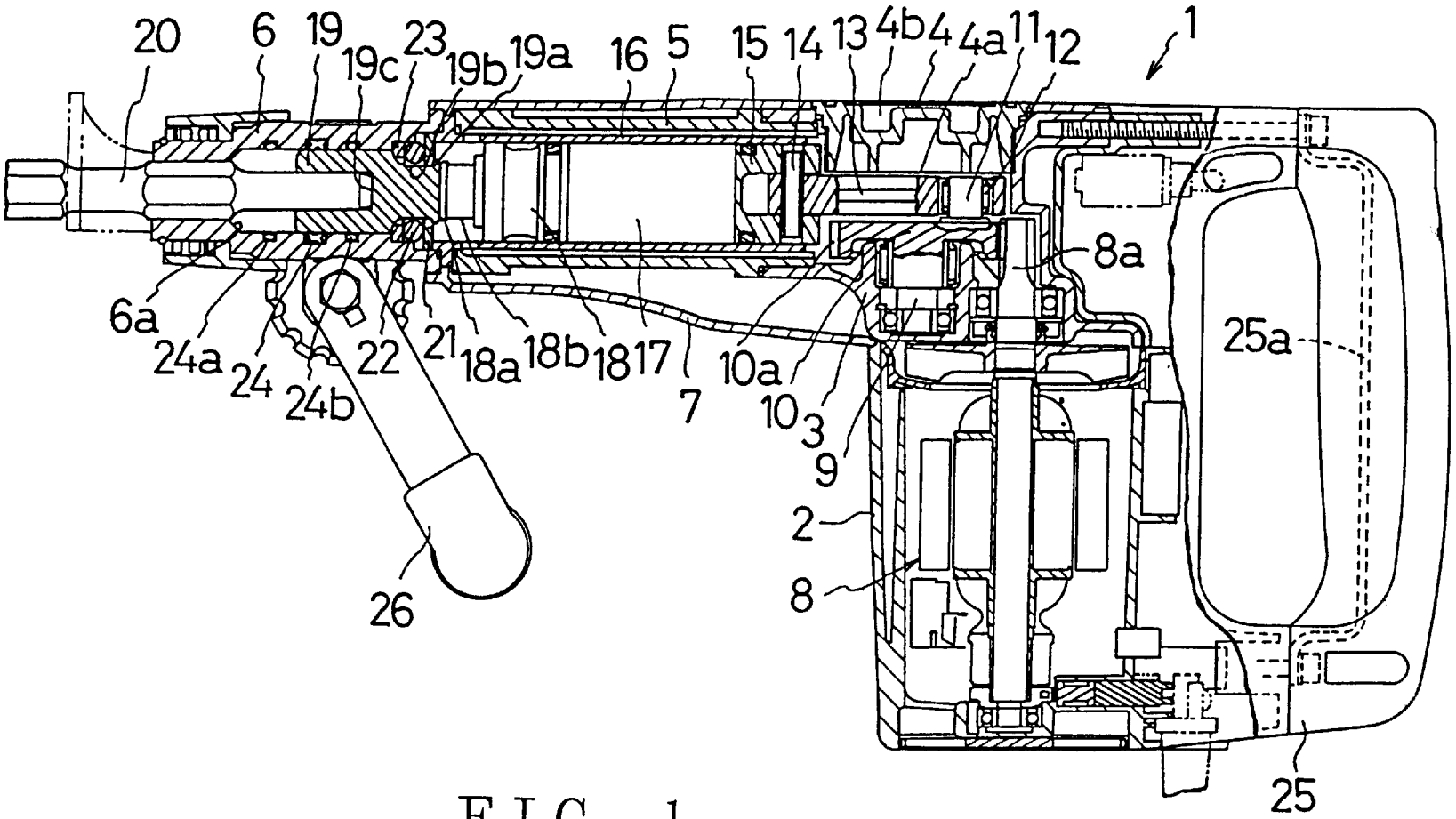
FIG. 1 is a partial cross sectional view illustrating a power-driven hammer embodying the invention.

FIG. 1 is a longitudinal partial cross section view of a power-driven hammer 1. A motor shaft 8*a* of a motor 8 is installed in a motor housing 2. The motor shaft 8*a* is engaged with a pinion 10*a* of a crank 10 supported at a shaft 9 by a crank housing 3 to rotate the crank 10. Then an eccentric pin 11 protruding parallel to the axis of the crank 10 is connected with a crank rod 13 via a needle bearing 12. This configuration converts the rotation of the crank 10 into the reciprocating motion of a piston 15 via the eccentric pin 11 and crank rod 13, with the piston 15 connected to an end of the crank rod 13 by a pin 14. The extension and retraction of the piston 15 in a cylinder 16 secured in a cylindrical barrel 5 causes a striking member 18 to make reciprocating motion via an air chamber 17. This in turn causes the striking member 18 to strike an intermediate element 19 located in front thereof, with the impact of the strike transmitted to a bit 20 held in a tool holder 6 since the rear portion of the bit 20 is fitted into the intermediate element 19. (In this embodiment, the term front refers to the direction of the bit.)

Furthermore, a housing cover 7 is provided on the outer surfaces of the crank housing 3 and the barrel 5. The housing cover 7 extends over the barrel 5, whose temperature rises when the power-driven hammer is in operation. The housing cover 7 is held in position by being fitted with a top 4*b* of an oil cap 4 fitted in the crank housing 3. The oil cap 4 has a bottom end 4*a* located close to the upper surface of the crank rod 13 , so that it checks any upward shift of the crank rod 13 and prevents the crank rod 13 from slipping out of the eccentric pin 11. Instead of forcing the needle bearing 12 into the crank rod 13 in assembly, the needle bearing 12 is set in the mold when forming the synthetic resin crank rod 13 and the needle bearing 12 into one piece. Accordingly, neither stress nor strength reduction occurs at the joint.

In the tool holder 6, a heat-resistant O-ring 22 is held between two steel washers 21 and 23 near the joint to the barrel 5. This O-ring has a cross-sectional diameter of approximately 7 mm, which is greater than the average for use in this type of power-driven hammer, with its inner diameter designed slightly greater than the diameter of the cylindrical portion 19*b* formed at the rear of the intermediate element 19 and slightly smaller than the diameter of a flange 19*a* formed on the rear end of the cylindrical portion 19*b*. Likewise, the inner diameter is designed slightly greater than the diameter of the recess 18*b* formed in the front of the striking member 18 and slightly smaller than the diameter of a flange 18*a* formed at the front of the recess 18*b*. The O-ring 22, due to its elasticity, is capable of holding and releasing the recess 18*b* and the cylindrical portion 19*b* alternately. Specifically, the cylindrical portion 19*b* of the intermediate element 19 is extended backward for such a distance that, when the cylindrical portion 19*b* is fitted in the O-ring 22 as shown in FIG. 1, the flange 19*a* is positioned behind, and out of contact with, the O-ring 22. An X-ring 24 and O-rings 24*a* and 24*b* which serves as oil scrapers are additionally provided on the inner surface of the tool holder 6.

The numeral 25 denotes a handle secured to the main body by bolts screwed into the main body via a reinforcing strip 25*a* (this need not be a flat strip; a material having a T-shape or U-like cross section will also suffice) provided inside. The numeral 26 denotes a side handle pivotally attached to the tool holder 6 for adjusting its angle.

When this power-driven hammer 1 arranged as described above is operated for normal use, such as chipping, the rotation of the motor shaft 8*a* is first converted into the reciprocating motion of the piston 15 by the crank 10 and crank rod 13 as explained above. This causes the striking member 18 to strike the intermediate element 19 and indirectly the bit 20 inserted into a bottomed bore 19*c* formed in the front of the intermediate element 19. At this moment, the bit 20 pushes the flange 19*a* of the intermediate element 19 beyond the O-ring 22 and causes the cylindrical portion 19*b* to fit into the O-ring 22 as shown in FIG. 1. Since the O-ring 22 serves as a stopper against the intermediate element 19 via the washer 23 in the present situation, the recoil of the bit 20 transmitted to the intermediate element 19 is reduced, thereby decreasing the vibration and impact in the other parts of the tool during operation.

Figure 2:
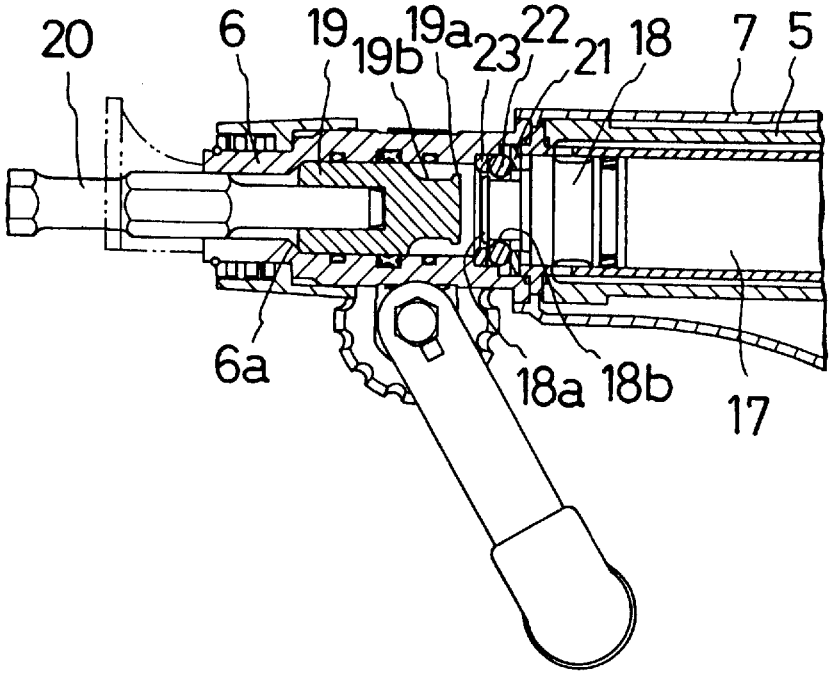
FIG. 2 illustrates idling operation of the power-driven hammer of the first embodiment.

When the piston 15 reciprocates with the tip of the bit 20 out of contact with the ground or some other work surface, the reciprocation motion causes the striking member 18 to strike the intermediate element 19, hence thrusting the bit 20 to the foremost position as shown in FIG. 2. Following the above strike, the large-diameter flange 19*a* is brought into contact with and, then detached from, the O-ring 22, so that the intermediate element 19 is braked. This in turn decreases the colliding speed of the intermediate element 19 as it collides with the bottleneck 6*a* and reduces its recoil. Meanwhile, the flange 18*a* of the striking member 18 moves beyond the O-ring 22 propelled by the momentum of the thrust, with the recess 18*b* fitting into the O-ring 22. Consequently, the reciprocating piston 15 no longer actuates the striking member 18, thereby preventing further idling strikes. Even if the striking member 18 is not held in the O-ring 22 upon colliding against the intermediate element 19 following the above-mentioned idling strike, the flange 19*a* of the intermediate element 19, now thrust in the forward position, is prevented from moving backward by the O-ring 22. Therefore, the reciprocating motion of the piston 15 is not transmitted to the striking member 18 in this case either. Although the O-rings 24*a* and 24*b* also act as additional brakes on the intermediate element 19, the O-ring 22 alone would provide sufficient braking.

To resume work, the tip of the bit 20 is abutted with the ground and pushed through the tool holder 6 to the position shown in FIG. 1. Meanwhile, the bit 20 pushes back the intermediate element 19 into abutment with the striking member 18 and dislodges the recess 18*b* from the O-ring 22. When the recess 19*a* of the intermediate element 19 fits into the O-ring 22 again, the power-driven hammer 1 is in operable condition.

In the striking tool of this embodiment, the simple and effective arrangement using a single O-ring in a single location performs three functions of reducing the recoil of the bit, and braking the impact of the intermediate element and catching the striking member in idle operation, thus achieving decreased vibration and shocks in normal operation and effective prevention of idling strikes in idle operation. Furthermore, the O-ring provides particularly effective cushioning and braking effects, since the O-ring comes into contact with the entire outer periphery of the intermediate element 19 by engaging with and releasing the cylindrical portion and the flange formed thereon.

Embodiment 2

The second embodiment of the present invention will now be explained. In the power-driven hammer of this embodiment, the striking member is designed to strike the bit directly, unlike the first embodiment, in which the intermediate element is interposed between the bit and the striking member. Identical reference numerals are used to indicate identical parts in the first and second embodiments; therefore, explanation thereof is dispensed with hereinafter.

Figure 3:
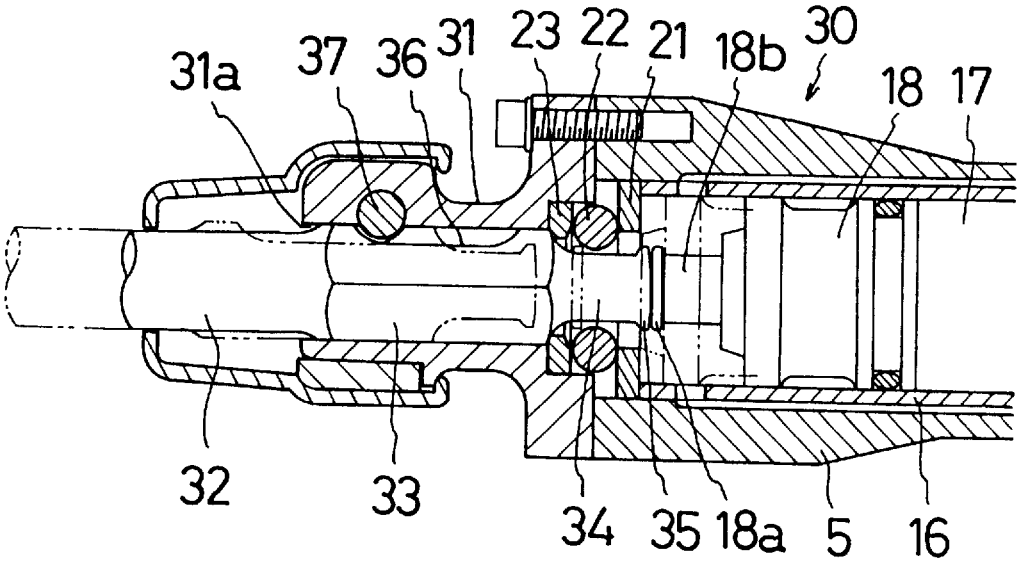
FIG. 3 illustrates another power-driven hammer as a second embodiment of the invention.

Referring to FIG. 3, in a power-driven hammer 30, a bit 32 comprises a hexagonal portion 33 inserted in a hexagonal bore 31*a* formed in a tool holder 31 and a cylindrical portion 34 which is extended from the rear end of the hexagonal portion 33. The cylindrical portion 34 has a smaller diameter than that of the hexagonal portion 33. Also, a flange 35 is formed on the periphery of the rear end of the cylindrical portion 34. The inner diameter of the O-ring 22 is made slightly greater than the outer diameter of the cylindrical portion 34 and slightly smaller than the outer diameter of the flange 35, and the hexagonal bore 31*a* of the tool holder 31 is designed such that the flange 35 can pass therethrough. Accordingly, when the bit 32 is pushed into the hexagonal bore 31*a* of the tool holder 31, the rear end of the hexagonal portion 33 abuts on the washer 23 and stops. At the same time, the flange 35 passes through the O-ring 22 due to its elasticity, stopping in a position out of contact with the O-ring 22. Then, a stopper 37 is inserted through the tool holder at right angles. The forward movement of the bit 32 is limited by the abutment of the stopper 37 against an recess 36 formed in the upper surface of the hexagonal portion 33 in the axial direction.

In the normal operation, such as chipping, of the power-driven hammer 30 constructed as stated above, the reciprocating motion of the piston (not shown) causes the striking member 18 to directly strike the bit 32. In this condition, the O-ring 22 limits the backward movement of the bit 32 via the washer 23, and the elasticity of the O-ring 22 reduces the vibration and impact of the bit 32 transmitted to the rest of the tool.

When the piston reciprocates with the bit 32 out of contact with the ground or some other work surface, the striking member 18 strikes and thrusts the bit 32 out of the O-ring 22 to the foremost position in which the rear end of the recess 36 abuts against the stopper 37 as indicated in double dot and dash lines in FIG. 3. Following the strike, the large-diameter flange 35 is brought into contact with, and then detached from, the O-ring 22, so that the bit 32 is braked, which in turn reduces the speed of the bit 32 at which it collides against the stopper 37 and reduces its recoil. On the other hand, the flange 18*a* of the striking member 18 moves beyond the O-ring 22 propelled by the momentum of the thrust as explained above, with the recess 18*b* fitting into and held by the O-ring 22.Consequently, the striking member 18 is no longer interlocked with the reciprocating piston 15, thereby preventing further idling strikes.

According to the present striking tool with no intermediate element, by performing simple work on the bit, the single O-ring also performs the three functions of reducing the recoil of the bit in normal operation, braking the bit and catching the striking member in idle operation, hence achieving the same effects as in the first embodiment.

Although an O-ring is used as the elastic member in the both embodiments, it should be understood that the shape and size of the elastic member are not limited to those described and that modifications and variations of the present invention may be made within the scope of the invention. For instance, the O-ring may be made uneven on the area that comes into contact with the flanges to enhance the braking effect. Furthermore, elastic bodies in a spherical or other shape may be arranged in a circle in place of the O-ring, as long as the replacement is capable of performing the above-stated three functions.

There may be many other modifications, alternations, and changes without departing from the scope or spirit of essential characteristics of the invention. It is thus clearly understood that the above embodiments are only illustrative and not restrictive in any sense. The scope and spirit of the present invention are limited only by the terms of the appended claims.

What is claimed is:

1. A mechanism for preventing idling strikes suitable for use with a striking tool having a piston for transmitting reciprocating motion through an air cushion to a striking member and an intermediate element coupled to a tool bit, said striking member colliding with said intermediate element during said reciprocating motion, the mechanism comprising an elastic member provided between the intermediate element and the striking member, said elastic member being configured to releasably hold one of the intermediate element and the striking member, during operation, and a flange provided on the intermediate element and positioned such as to be out of contact with the elastic member and disposed on a same side of the elastic member as the striking member during operation, the flange having a diameter greater than an inner diameter of the elastic member, the flange contacting the elastic member so as to decrease the momentum of the intermediate element during idling.

2. The mechanism for preventing idling strikes suitable for use with a striking tool in accordance with claim 1, wherein the elastic member is an O-ring.

3. A mechanism for preventing idling strikes suitable for use with a striking tool having a piston for transmitting reciprocating motion through an air cushion to a striking member and a tool bit, said striking member colliding with said tool bit during said reciprocating motion, the mechanism comprising an elastic member provided between the bit and the striking member, said elastic member being configured to releasably hold one of a rear end of the bit and the striking member during operation, and a flange provided on the bit and positioned so as to be out of contact with the elastic member and disposed on the same side of the elastic member as the striking member, the flange having a diameter greater than an inner diameter of the elastic member, the flange contacting the elastic member so as to decrease the momentum of the bit during idling.

4. The mechanism for preventing idling strikes suitable for use with a striking tool in accordance with claim 2, wherein the elastic member is an O-ring.

5. A mechanism for preventing idling strikes in a striking tool, the striking tool having a piston for transmitting reciprocating motion, in a forward direction, through an air cushion to a striking member and having an intermediate element coupled to a tool bit, said striking member colliding with said intermediate element during said forward reciprocating motion, the mechanism comprising an elastic member provided within the tool, and a flange provided on a reduced diameter portion of the intermediate element, said flange being positioned at a rear portion of the intermediate element, said reduced diameter portion being positioned during normal operation to reciprocate through said elastic member as a result of the striking member colliding with the intermediate element, the flange having a diameter greater than an inner diameter of the elastic member and being configured to pass through the elastic member during idling as a result of an impact from the striking member to release said reduced diameter portion from said elastic member.

6. A striking tool comprising a housing having an axis and a front end, a piston positioned within the housing for reciprocating motion along the axis of the housing, a striking member positioned within the housing and separated from the piston by an air cushion, the piston transmitting reciprocating motion through the air cushion to the striking member, an intermediate element coupled to a tool bit at the front end of the housing, the striking member colliding with the intermediate element to transmit reciprocating motion to the tool bit, an elastic member positioned to releasably hold the intermediate element during operation, and a flange provided on the intermediate element and positioned such as to be out of contact with the elastic member and disposed between the elastic member and the striking member during operation, the flange having a diameter greater than the inner diameter of the elastic member, the flange contacting the elastic member during idling so as to decrease the momentum of the intermediate element.

7. A striking tool comprising a housing having an axis and a front end, a piston positioned within the housing for reciprocating motion along the axis of the housing, a striking member positioned within the housing and separated from the piston by an air cushion, the piston transmitting reciprocating motion through the air cushion to the striking member, a tool bit coupled to the front end of the housing, the striking member colliding with the tool bit to transmit reciprocating motion to the tool bit, an elastic member positioned to releasably hold the tool bit during operation, and a flange provided on the tool bit and positioned such as to be out of contact with the elastic member and disposed between the elastic member and the striking member during operation, the flange having a diameter greater than the inner diameter of the elastic member, the flange contacting the elastic member during idling so as to decrease the momentum of the tool bit.

8. A striking tool comprising a housing having an axis and a front end, a piston positioned within the housing for reciprocating along the axis of the housing, a striking member positioned within the housing and separated from the piston by an air cushion, the piston transmitting forward reciprocating motion through the air cushion to the striking member, an intermediate element coupled to a tool bit at the front end of the housing, the striking member colliding with the intermediate element to transmit forward reciprocating motion to the tool bit, the intermediate element including a reduced diameter portion, an elastic member provided within the tool, the reduced diameter portion being positioned during normal operation to reciprocate through the elastic member as result of the striking member colliding with the intermediate element, and a flange provided on the reduced diameter portion of the intermediate element, the flange being positioned at a rear portion of the intermediate element, the flange having a diameter greater than an inner diameter of the elastic member and being configured to pass through the elastic member during idling as a result of an impact from the striking member to release the reduced diameter portion from the elastic member.

* * * * *